United States Patent [19]

Capobianco

[11] 4,257,359

[45] Mar. 24, 1981

[54] MECHANISM FOR ROTATING AND RECIPROCATING A SOOT BLOWER

[75] Inventor: Salvatore A. Capobianco, Windsor, Conn.

[73] Assignee: Combustion Engineering, Inc., Windsor, Conn.

[21] Appl. No.: 43,582

[22] Filed: May 29, 1979

[51] Int. Cl.[3] ..... F23J 3/02

[52] U.S. Cl. ..... 122/390; 15/317

[58] Field of Search ..... 122/379, 390, 391, 392; 15/316, 317, 318

[56] References Cited

U.S. PATENT DOCUMENTS

| | | | |
|---|---|---|---|
| 2,384,940 | 9/1945 | Lumb et al. | 15/317 |
| 2,760,222 | 8/1956 | Andersson | 122/390 X |
| 3,377,026 | 4/1968 | De Mart et al. | 15/317 |
| 3,664,310 | 5/1972 | Locke et al. | 122/390 X |

FOREIGN PATENT DOCUMENTS

| | | | |
|---|---|---|---|
| 2162499 | 12/1971 | Fed. Rep. of Germany | 122/390 |
| 250359 | 3/1967 | U.S.S.R. | 122/390 |

*Primary Examiner*—Edward G. Favors
*Attorney, Agent, or Firm*—Arthur L. Wade

[57] ABSTRACT

A short-stroke steam lance is reciprocated through an opening in a furnace wall. A protuberance is mounted on a section of the lance to extend into spiral grooves of a structure mounted on the framework. The steam to the lance is supplied when its valve is actuated by the lance moved into its extreme forward position.

7 Claims, 7 Drawing Figures

MECHANISM FOR ROTATING AND RECIPROCATING A SOOT BLOWER

BACKGROUND OF THE INVENTION

1. Field of the Invention

The present invention relates to a short-stroke wall soot blower, for a furnace, which rotates and reciprocates its lance between the operative and inoperative positions of the lance. More specifically, the present invention relates to activating a wall soot blower in rotation and reciprocation by mechanical coupling to a single power source.

2. Description of the Prior Art

Combustion of fuels in a utility boiler produces huge amounts of particulate matter which accumulates on heated surfaces and reduces the heat transfer from the combustion to liquids to be vaporized. Coal firing is very productive of particulate matter, be it in the form of soot and/or slag. The lower the quality of coal, the more quickly is the accumulation of particulate matter on surfaces heated by the combustion. Removing structure must be frequently inserted into the furnace space to sheer away the accumulations which are the enemies of heat transfer.

Enter the soot blower. Essentially, the soot blower is a conduit, with a nozzle at its end, inserted into a hole in the wall of the furnace. Steam, or air is fed into the tube and ejected from its nozzle with great force. Correctly directed in the form of a spray, the fluid belching from this conduit can effectively shear particulate matter from large areas of the heated surfaces.

In the huge, multi-storied utility boiler, it is not uncommon to supply up to 300 soot blowers or more. Rows of these blowers are mounted at their furnace openings, the rows being on the order of vertical and horizontal 8' centers. Further, the lances of the blowers are reciprocated between their operative and inoperative positions to sequentially cut at the accumulations on the heating surfaces and maintain the efficiency of heat transfer from the combustion process to the vaporizable liquid behind the heating surfaces.

The environment in which the soot blower operates is inherently dirty. Coal dust in the atmosphere about a boiler is an unavoidable fact of the life of this tool. This dirt is an enemy to the mechanical system between the electric or air motive means and the soot blower with which the motive means rotates and reciprocates the soot blower lance.

In the short stroke wall blower, there is the problem of coring the vapor conduit, or lance, through its furnace opening which has been bridged by an accumulation of slag. It is necessary that this obstruction be cored through to bring the lance into its operative position. Therefore, a mechanism is necessary to actuate the lance and its cutting elements mounted thereon to position the nozzle end of the lance within the furnace. Once into the interior of the furnace, cleaning fluid is discharged in a pattern which will dislodge the accumulation of particulate matter from the internal wall of the furnace. Although other fluids could be employed, high pressure steam is the most available cleaning medium. The steam is conducted to each blower through a feed tube and the outer casing of the lance is rotated and reciprocated over a substantial length of the feed tube. Obviously, some form of seal between the outer surface of the feed tube and the rear of the lance casing is necessary to contain the cleaning medium and force it from a nozzle mounted on the forward end of the casing. Thus, in the environment about the utility boiler, which is hostile to mechanical motion and sealing, are the problems of dirt isolation to preserve efficient articulation of the parts of the blower which must move relative to each other.

SUMMARY OF THE INVENTION

The present invention contemplates a single motive means mechanically linked to rotate the lance of a soot blower while a fixed protuberance on the lance engages a spiral structure which is in a fixed position radial and external to the lance to cause reciprocation of the lance between its operative and inoperative positions.

Other objects, advantages and features of this invention will become apparent to one skilled in the art upon consideration of the written specification, appended claims and attached drawings.

BRIEF FIGURE DESIGNATIONS

DESCRIPTION OF THE PREFERRED EMBODIMENT

Figure 1:
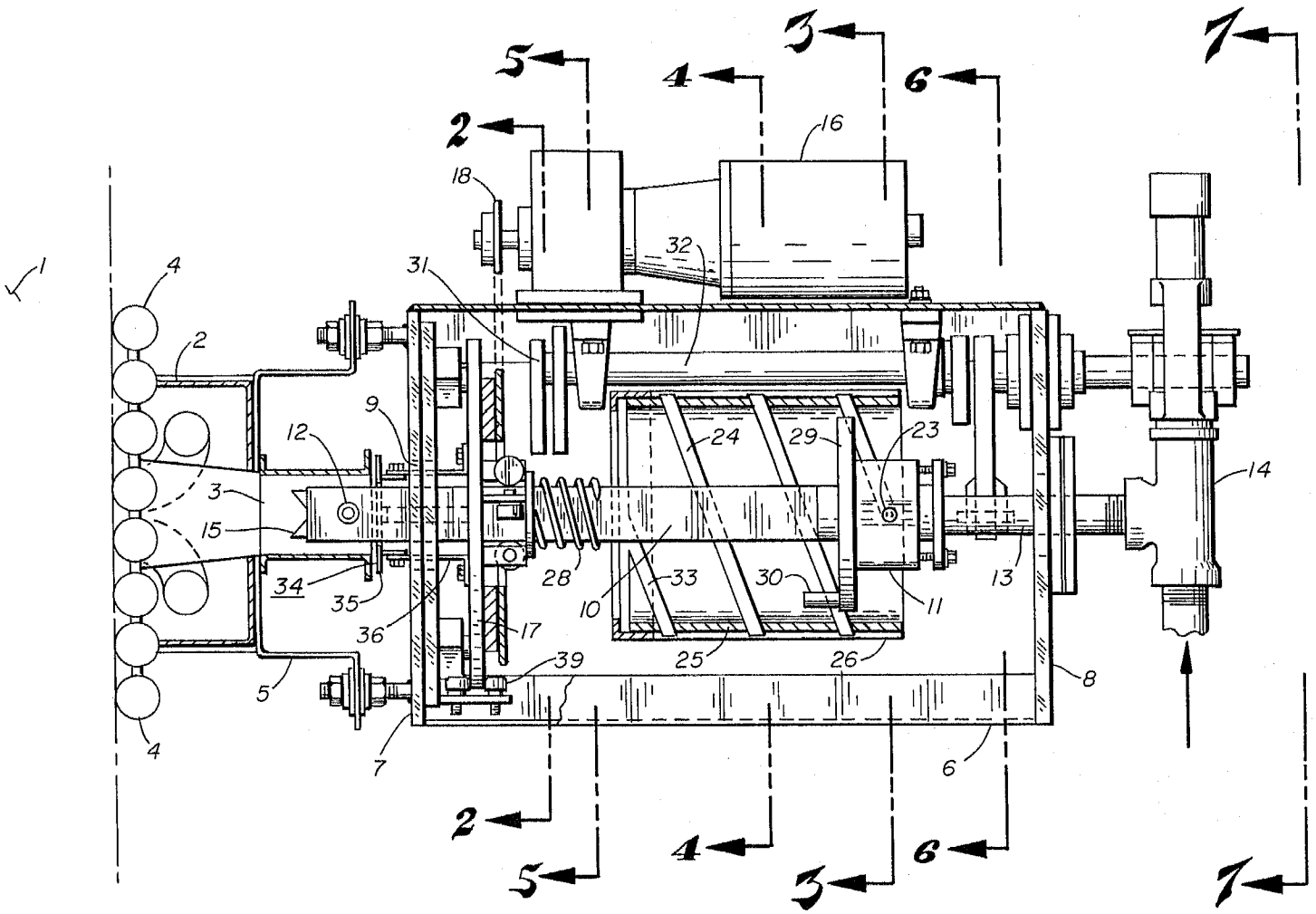
FIG. 1 is a plan view of a soot blower in its inoperative position ready to be forced to its operative position and embodying the present invention.

Referring specifically to FIG. 1, all of the essential structure of the embodying soot blower is disclosed. The structure is viewed from above. The interior of the furnace at 1 may be considered to the left with the wall 2 having an opening 3 through which the lance of the soot blower is extended to take its operative position.

A minimum of internal wall structure is disclosed. There is some indication of furnace tubes 4 on the internal surface of the furnace wall. It is these tubes and the wall of the furnace upon which they are mounted which are cleaned by the soot blowers. Soot, slag, particulate matter, etc. accumulate on this area of the furnace wall and must be removed by cleaning vapor sprayed from the end of the lance thrust through opening 3. This is sufficient structure for one skilled in the art to readily appreciate that the lance is extended only that short distance from the inoperative position disclosed in FIG. 1 to bring the vapor discharged from the end of the lance to bear on the accumulation of the matter on the interior surface of the furnace and the tubes mounted thereon.

More specifically, the tubes 4, as they are mounted on wall 2, are distorted to provide enough furnace wall face in which to form opening 3. Further, it can readily be appreciated that the slag, soot and debris deposit on the wall 2 will likely bridge over opening 3. This accumulation on opening 3 may become quite hard, effectively resisting the force which is applied to bring the lance through opening 3. The disclosure will provide cutting elements mounted on the tip of the forward end of the lance which will effectively core through expected obstructions as the lance is rotated in its advance.

The lance, which is essentially a vapor conducting conduit, is provided a framework for its support. Supported by this framework, the lance is rotated and reciprocated to carry out the cleaning function. Although it is to be clearly understood that the invention is not limited to the use of steam as a cleaning vapor, the disclosure will now uniformly refer to steam as the preferred high pressure vapor normally available in amounts required by the soot blower.

Support for the lance begins with the first frame 5 mounted about opening 3. This frame is directly attached to the external side of the furnace wall to provide a housing for a seal and scraper structure through which the lance is passed.

The basic framework for support of the lance is mounted on the second frame 6 and extends normal to the plane of the furnace wall as far as necessary to accommodate the lance. This second frame 6 is disclosed as a sturdy, rectangular structure including a forward plate 7 attached to the first frame 5 with side members extending to a back plate 8. This back plate forms a wall through which the vapor feed tube for the lance penetrates. This back plate 8 also provides structural support for the linkage to the control valve for steam connected between the source and the feed tube as well as for the valve itself. The forward plate 7 has an opening 9 through which the lance extends and through which the support members also extend for the seal and scraper structure in frame 5.

The lance itself is disclosed in two basic parts. Keeping in mind that the lance is essentially a conduit, or pipe, the first, or front, conduit section 10 is journaled through the front wall of frame 6 to extend through frame 5 and into the opening 3. The second conduit section 11 is connected to the first section as a rearward extension so that together they may be looked upon as the lance of the blower.

Nozzles 12 are mounted on the furnace end of conduit 10 of the lance. It is from these nozzles that the steam jets out upon the matter to be removed from the furnace wall 2. The present invention has no concern with the shape, position or direction of these nozzles. The nozzles are simply moved into their operative positions for effectively steam cleaning that area of the internal wall of the furnace which is the responsibility of the soot blower.

At the back end of the lance, feed tube 13 is extended through the back plate 8 of the second frame 6 and is sized and arranged to telescope into second conduit section 11. A gland, well-developed in the prior art, is provided between the internal wall of section 11 and the external surface of the feed tube to insure that the high pressure steam is flowed to its discharge through nozzles 12. The steam is made available to feed tube 13 through a conduit connecting feed tube 13 and a source not shown. Valve 14 controls the flow of steam from the source of the feed tube 13, depending upon how the valve is actuated.

It is contemplated that valve 14 will remain closed until nozzles 12 on the lance are moved into their operative position. Then valve 14 will be opened and the high pressure steam flowed to the nozzles 12 and discharged therethrough in performance of the ultimate objective of the soot blower. Therefore, the lance is reciprocated from the position disclosed in FIG. 1 to a second position to the left as viewed in FIG. 1 which has been heretofore termed "the operative position". While this reciprocation is taking place, structure is provided by the present invention to rotate the lance. Viewed another way, the lance is rotated by motive means to which it is linked. The motive means is mounted on frame 6 and is reversibly rotated to reciprocate the lance through the linkage. The rotation and reciprocation are, therefore, brought about through this single motive means. The reason for the reciprocation is immediately obvious in that the nozzles 12 must be thrust to their effective position within the furnace space 1. It next becomes obvious that the rotation during this reciprocation initially provides the cutting action with cutting structure 15 to penetrate any obstruction of opening 3. Once in its operative position, the lance is rotated to eject steam from the nozzles in a circular pattern in carrying out their cleaning function.

The lance is rotated by applying the power of the motive means to the first conduit section 10. The problem is to provide a gear train between conduit section 10 and motor 16. Motor 16 is a simple electric motor which can be reversed as desired. The motor is mounted at a stationary location which may be on frame 6 as shown or to one side of it. This specific location is not important to the disclosure of the present invention.

Figure 2:
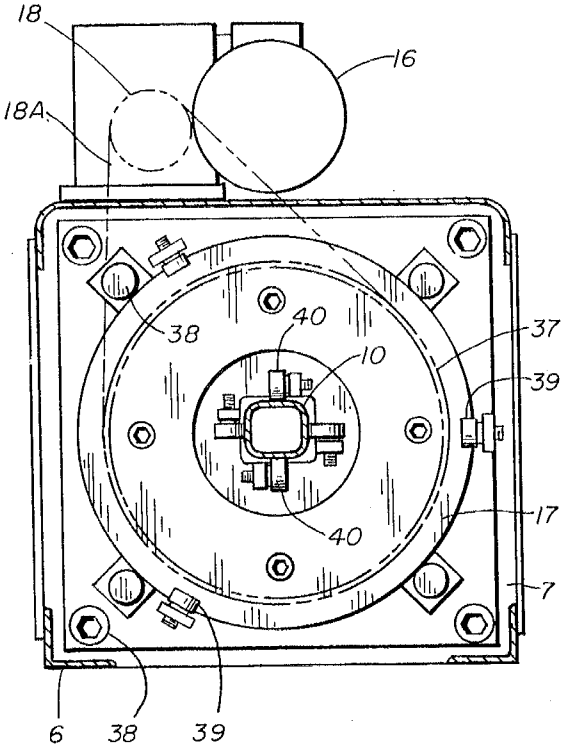
FIG. 2 is a sectional elevation along lines 2—2 of FIG. 1, showing the mechanical linkage between the electrical motive means and the lance.

The arrangement that is important is the gear train as linkage between the motor 16 and conduit section 10. First conduit section 10 is given a cross-sectional shape which will effectively engage a structure through which the section is extended. More specifically, this cross-sectional shape is preferred as square and the section is extended through a table 17 which is rotatably mounted on the forward plate 7 of frame 6. Therefore, rotation of table 17 causes rotation of the lance and bearings provide rolling contact between table 17 and the surface of section 10 during reciprocation. Once the table is established in place, a sprocket and chain linkage 18 is extended between the table and the shaft of motor 16. Actuation of motor 16 will then rotate the lance in either of two directions of rotation. While rotated, the lance is free to reciprocate between the position shown in FIG. 1 and the operative position to the left as viewed in FIG. 1. FIG. 2 as a section discloses the motor and its linkage to lance conduit 10 to further advantage.

Reciprocation is provided by proper linkage between conduit section 11 and frame 6. More specifically, an extension structure 19 is mounted upon conduit section 11 to extend radially outward to engage a spiral groove in structure mounted fixedly to second frame 6. As the lance is rotated, this fixed linkage between the frame and conduit section 11 forces reciprocation of the lance.

Figure 3:
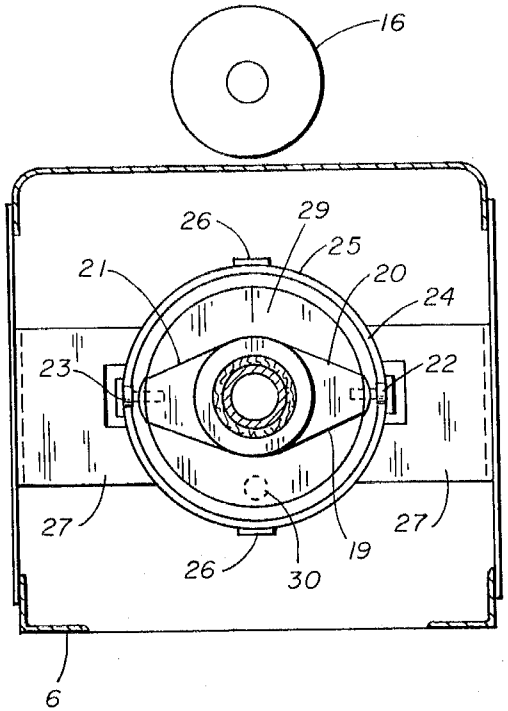
FIG. 3 is a sectional elevation along lines 3—3 of FIG. 1, showing the frame mechanically linked to the lance through which the rotated lance is forced to reciprocate.

For a more understandable and complete disclosure of the linking structure, FIG. 1 is to be coordinated with FIG. 3. In FIG. 3, the extension 19 which is fixed to conduit section 11 is disclosed as having two arms 20 and 21 radiating from and mounted on section 11. On the ends of these arms, rollers 22 and 23 are positioned within different portions of the helical groove 24 formed in cylindrical tube 25. Tube 25 is journaled over the lance and fixed to the internal walls of frame 6. With groove 24 formed in the wall of tube 25, support members 26 are provided the length of tube 25 to preserve the integrity to groove 24.

Figure 4:
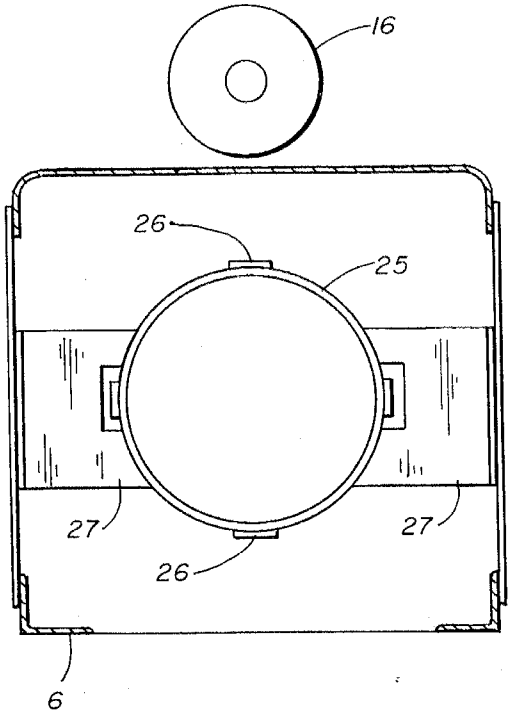
FIG. 4 is a sectional elevation along lines 4—4 of FIG. 1, showing how the helical tube is mounted on the lance frame.

FIG. 4 discloses the additional support elements 27 which stabilize the relation between the tube 25 and the lance over which tube 25 is journaled. As the lance is rotated through the linkage with motor 16, the lance will be reciprocated through the linkage provided between extension arms 20 and 21 and tube 25.

Assuming motor 16 has both rotated the lance counter clockwise and moved the lance to the operative position, it is readily visualized that the end of conduit section 11 engages the end of spring 28. Completion of the lance movement to the left compresses spring 28 to exert a predetermined force to return the lance to the right. However, the force of spring 28 is overcome and the lance reaches its operative position against the force of spring 28.

In the operative position of the lance, the present invention provides the actuation of linkage of valve 14 to flow steam to nozzles 12. There are variations of linkage which will provide this actuation. In the present disclosure, a plate 29 is mounted at the juncture of lance conduit sections 10 and 11. This plate 29 rotates with the lance because it is fixed thereto. Further, plate 29 is moved forward, to the left, as the lance is advanced toward its operative position.

It is this plate 29 against which spring 28 bears as the lance takes its operative position. Also, rod projection 30 is extended forward from the surface of plate 29. The spacing and travel are readily arranged for projection 30 to contact cam 31 as the lance reaches its operative position. Cam 31 extends downward from valve rod 32 where it will be engaged with projection 30 and be moved in an arc which will clear it from the path of plate 29 and rotate the valve rod 32 to open steam valve 14.

The plate, with its projection 30 mounted thereon, is carried forward past cam 31. Spring 28 is depressed to exert force to the right on the lance. Extension 19 reaches continuous circular groove 33 and continued counter-clockwise rotation by motor 16 will result in nozzles 12 discharging steam from the feed tube at the operative position for as long as motor 16 is engaged to rotate the lance counter-clockwise.

Reversal of motor 16 will enable the force of spring 28 to initiate the movement of the lance backward, engaging the rollers of extension 19 with helical groove 24. The engagement of the rollers of extension 19 with the sides of helical groove 24 while the lance is rotated clockwise will move the lance backward to the position shown in FIG. 1. As plate 29, with its rod projection 30, is carried back toward the position shown in FIG. 1, cam 31 is engaged from its opposite side and valve rod 32 returned to the position at which they cause valve 14 to be closed.

A cycle of lance reciprocation has been completed. The lance has been moved from the position shown in FIG. 1 to its forward operative position and returned to the position shown in FIG. 1. The rotation of the lance by motor 16 has brought about the reciprocation. Further, in the operative position, the lance has rotated a predetermined length of time, or desired number of rotations, for the vapor issuing from the nozzles 12 to do its work. Valve 12 has been opened as the lance reaches its operative position and closed as the lance is withdrawn to its position shown in FIG. 1. During the reciprocation, the lance is kept scraped clean by the structure in first frame 5.

A scraper-seal structure 34 is disclosed within frame 5 as about the forward lance portion 10. The scraper-seal structure 34 is comprised of seal plates 35, each plate mounted on a finger 36 which is, in turn, mounted on the front face of table 17. Each finger 36 is essentially a rod-like member protruding from the front face of table 17, through opening 9 in forward plate 7. These elements are quite similar to disclosure C-770820 dated Jan. 8, 1979, and function in the same way.

FIG. 2, as heretofore indicated, is a section disclosing the table 17 as a part of the linkage between motor 16 and lance section 10. Frame-housing 6 encloses table 17 and mounts motor 16 on its upper side. Sprocket 18 is rotated by motor 16. Chain 18A connects sprocket 18 and a similar sprocket 37 on table 17.

Table 17 has supporting edge bearings 38 which are mounted at the rim of table 17. Retaining bearings 39, together with edge bearings 38, form a complete low friction rolling contact between table 17 and forward plate 7. Rollers 40 are mounted on table 17 and clustered about the axial hole through table 17, bearing upon lance conduit 10. The result is a complete linkage between motor 16 and lance conduit 10 through which motor 16 rotates the lance in either of two directions upon command from an operator.

Figure 5:
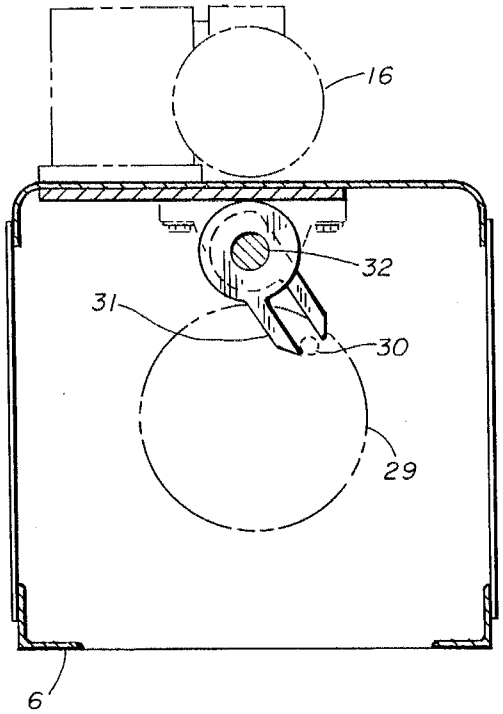
FIG. 5 is a sectional elevation along lines 5—5 of FIG. 1, showing the projection of the lance actuating the linkage to the steam valve.

FIG. 5, as mentioned, discloses cam 31 mounted on rod 32 where cam 31 will be engaged by rod projection 30. Plate 29, upon which rod projection 30 is mounted, is indicated as it, in turn, is mounted between lance sections 10 and 11. The outline of frame 6 and motor 16 thereon are indicated to tive orientation to the view.

Figure 6:
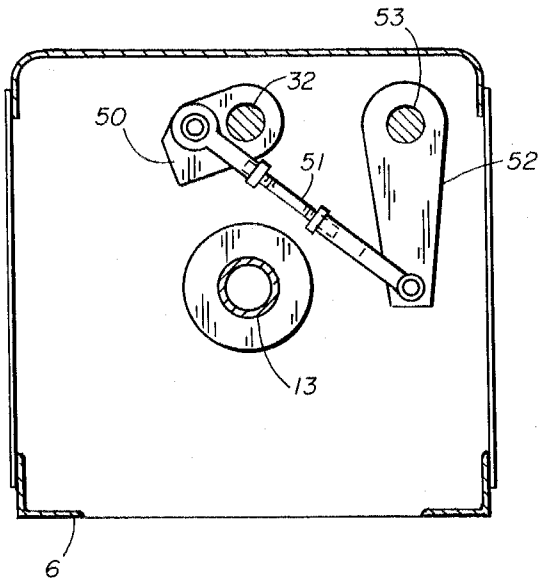
FIG. 6 is a sectional elevation along lines 6—6 of FIG. 1, showing the rear portion of the linkage between the lance and the steam valve.

FIG. 6 is a section with which to specifically disclose the linkage between the rear end of valve rod 32 and steam valve 14. Rod 32 is shown with an arm 50 mounted thereon. Arm 50 is connected by an adjustable link 51 to a first arm 52 which is connected to pivot a rod 53 mounted on the arm 52. All these elements 50–53 may be simply catagorized as straight forward linkage through which valve rod 32 opens and closes steam valve 14. The travel limits of these structures are adjustable to provide the actuation of steam valve 14 as cam 31 is engaged by rod protuberance 30 when the lance is rotated in either of its two directions.

Figure 7:
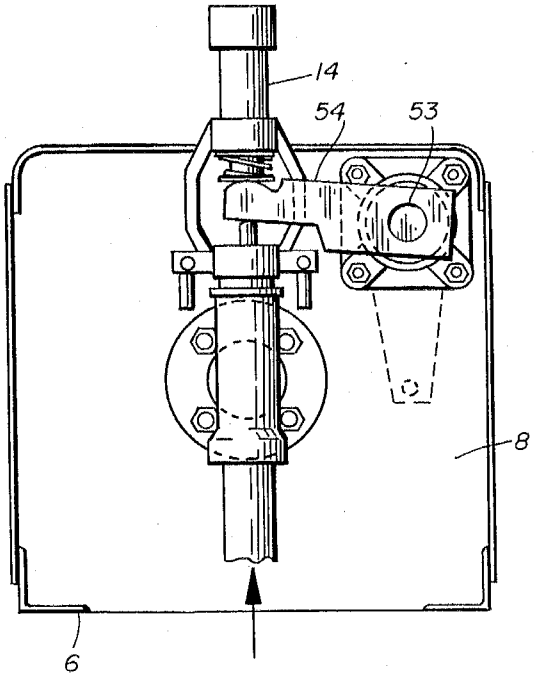
FIG. 7 is a sectional elevation along lines 7—7 of FIG. 1, showing the steam valve mounted on the frame of the blower and actuated by linkage to the lance.

FIG. 7 discloses steam valve 14 as it is mounted on the back plate 8. On rod 53 of FIG. 6 is mounted a second arm 54 which actually comes into contact with steam valve 14. This is the end of the linkage train. From cam 31, through rod 32, then to arm 50, thence to link 51, to arm 52, thence to rod 53, finally to arm 54, we have a train of linkage by which steam valve 14 is simply opened or closed. By this actuation, steam from the unshown source is turned into feed tube 13 or is isolated therefrom. The steam is conducted into feed tube 13 or is isolated therefrom. The steam is conducted into the feed tube when the lance is in its operative position. When the lance is removed from its operative position, the steam is shut off from the feed tube. Nothing could be more simple in results desired and achieved.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from this scope thereof, it is to be understood that all matter herein set forth or shown in the accompanying drawings is to be interpreted in an illustrative and not in a limiting sense.

The invention having been described, what is claimed is:

1. A structure for inserting a fluid lance within a furnace and delivering fluid onto the internal wall of the furnace to remove foreign matter from the wall, including, a furnace wall with an opening which provides access to the internal side of the wall from external the wall of the furnace, an elongated frame mounted by one end over the wall opening and extending normal the plane of the wall, a lance in the form of an elongated conduit mounted within the frame and provided a range of axial movement wherein it reciprocates from which range the lance extends one of its ends into the furance interior through the opening, a nozzle mounted on the first end of the lance which is inserted into the furnace interior from which cleaning fluid is injected into the interior of the furnace and onto the interior wall to remove foreign matter accumulated thereon, a feed tube extended into the second end of the lance within the frame to conduct cleaning fluid into the lance so it will exit through the nozzle on the first end of the lance, a valve in the feed tube to control the flow of cleaning fluid in the feed tube, a motive means mounted in stationary relationship to the frame, a linkage means between the motive means and the lance to rotate the lance by the motive means, a section of the frame containing spiral grooves about the lance, an extension structure mounted on the lance and extended into engagement with the spiral grooves which arrangement causes reciprocation of the connected lance over its range when the lance is rotated by the motive means, and actuating linkage connected to the fluid valve and extended to the forward end of the range of lance reciprocation in the arrangement whereby the lance contacts the linkage and actuates the valve to flow steam through the feed tube and into the lance when the nozzle of the lance is positioned within the furnace interior.

2. An apparatus for dislodging soot and slag and other particulate residue from the internal surfaces of furnaces, including;

a lance for cleaning fluid under pressure, including, (a) a first conduit section with a first end to be moved into an opening of the furnace wall, (b) a second conduit section connected as an extension of the first conduit section and provided with an extension to engage structure spaced radially from the lance, and (c) a feed tube sized to telescope into the second end of the grooved conduit section for conducting high pressure cleaning fluid into the other conduit sections of the lance;

a framework attached to the external side of the furnace wall adapted and arranged to support the lance in order for the first conduit section to be inserted through the opening in the furnace wall;

a source of pressure fluid;

a conduit connected between the source of pressure fluid and the feed tube including a valve for controlling the flow of fluid from the source of the feed tube;

a motive means mounted stationary relative to the framework and near enough to be linked to the first conduit section of the lance;

a spiral grooved structure mounted on the framework and spaced radially from the lance in order for its grooves to be engaged by the extension mounted on the second conduit section of the lance;

and linkage between the valve and the lance positioned and arranged to be actuated when the rotating and reciprocating lance reaches its advanced position;

whereby the motive means is controlled to rotate the lance and thereby reciprocate the lance with the lance actuating the valve when the lance has reached its extreme point of travel into the furnace.

3. The soot blower of claim 2, including, structure mounted on the forward end of the first conduit section which engages and penetrates any obstruction met by the advancing lance as it is moved into position to discharge cleaning fluid on the internal surfaces of the furnace.

4. The soot blower of claim 2, in which, the motive means is connected to the first conduit section of the lance through a gear train formed by an external shape of the section engaged by a rotatable bushing through which the conduit section extends and a sprocket and chain between the bushing and motive means.

5. A soot blower, including, a first frame mounted on the external surface of a furnace wall and over an opening through the wall, a second frame mounted as an extension of the first frame and extending normal the plane of the furnace wall, a fluid lance provided with a first portion of its length having a square cross section and mounted as an elongated conduit within the second frame and with a range of reciprocation to move its first end through the wall opening and into the furnace interior, a table mounted on the second frame engaging the square section of the first portion of the lance length and rotatable on its frame mounting, a motive means mounted at a position stationary relative to the second frame, linkage connected between the motive means and the table through which the motive means rotates the table and lance in either of two directions of rotation, a feed tube connected to a source of cleaning fluid and extending into the second frame and into the second end of the lance to supply cleaning fluid to the end of the lance reciprocated into the furnace interior, a control valve in the feed tube for regulation of the cleaning fluid flow into the lance, a control linkage for the valve extending and arranged to engage the lance when the lance has been extended into the furnace interior so as to provide cleaning fluid to the lance after the first end of the lance is positioned within the furnace, a spiral structure on the second frame and about the lance.

and an engaging structure mounted at a fixed position on the lance extending into engagement with the spiral structure on the second frame and about the lance to cause the lance to reciprocate over its range when the lance is rotated.

6. The soot blower of claim 5, in which, a scraping structure is provided within the first frame to engage the portion of the lance extended into the furnace to seal about the lance and remove foreign matter from the surface of the lance.

7. The soot blower of claim 5, including, a cutting structure mounted on the first end of the lance with which foreign matter bridging the opening of the furnace wall is cut and penetrated by the first end of the lance as the lance is rotated and moved to the forward end of its range of reciprocation.

* * * * *